United States Patent [19]

Ruiz

[11] 4,414,879

[45] Nov. 15, 1983

[54] CHROMATIC HARMONICA WITH REMOTE ACTUATOR

[76] Inventor: Joseph Ruiz, 11368 Braile, Detroit, Mich. 48228

[21] Appl. No.: 356,945

[22] Filed: Mar. 11, 1982

[51] Int. Cl.[3] ..... G10D 9/00
[52] U.S. Cl. ..... 84/379
[58] Field of Search ..... 84/377-379

[56] References Cited

U.S. PATENT DOCUMENTS 3,818,792 6/1974 Gerbetz ..... 84/379
4,212,219 7/1980 Hubbard ..... 84/379 X

*Primary Examiner*—Lawrence R. Franklin
*Attorney, Agent, or Firm*—Charles W. Chandler

[57] ABSTRACT

A chromatic harmonica having a boom mounted yoke for supporting the harmonica in front of the user, a solenoid mounted on one arm of the yolk for moving the valve actuator of the harmonica and a foot-operated switch for energizing the solenoid depending upon whether the harmonica is to produce sharp or flat tones.

4 Claims, 4 Drawing Figures

CHROMATIC HARMONICA WITH REMOTE ACTUATOR

BACKGROUND OF THE INVENTION

This invention is related to means for remotely operating a chromatic harmonica and more specifically to a foot-operated electrical device for remotely operating a chromatic harmonica so that the user can employ his hands for playing a second instrument.

Chromatic harmonicas are commonly used by musicians because of the wide range of tones that can be produced by moving a valve member that extends either beyond one end or the bottom of the harmonica. The valve member changes the harmonica tones for either sharps or flats depending upon its position.

Some musicians prefer to simultaneously play several instruments. It is necessary for the musician to have his hands available to play more than one instrument. One approach for using a harmonica as part of such an ensemble is to hang the harmonica around the user's neck and employ a foot-operated cable to remotely change the harmonica tones from sharps to flats. Such an arrangement was disclosed in U.S. Pat. No. 3,818,792 to Gerbetz. However, such an arrangement has several drawbacks. Its sensitivity is limited because of its mechanical nature. Further the length of the cable reduces its utility because if the cable is made sufficiently long for the performer to stand, it has a tendency to kink or bind if he assumes a seated position.

SUMMARY OF THE INVENTION

The broad purpose of the present invention is to provide an improved foot-operated actuator for a harmonica including an electrically-actuated solenoid, mounted on a boom-supported yoke, to actuate the valve member, and a foot-operated switch arranged to energize the solenoid depending upon the position of the operator's foot. Such an arrangement provides several advantages over a mechanical actuator. For example, an electrically energized actuator is much more responsive to the user's foot and therefore more closely approaches the quickness of the user's hand than a mechanically actuated cable. A flexible electrical cord between the foot-operated switch and the solenoid permits the user to stand, sit or assume another position without interferring with the performance of the apparatus.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
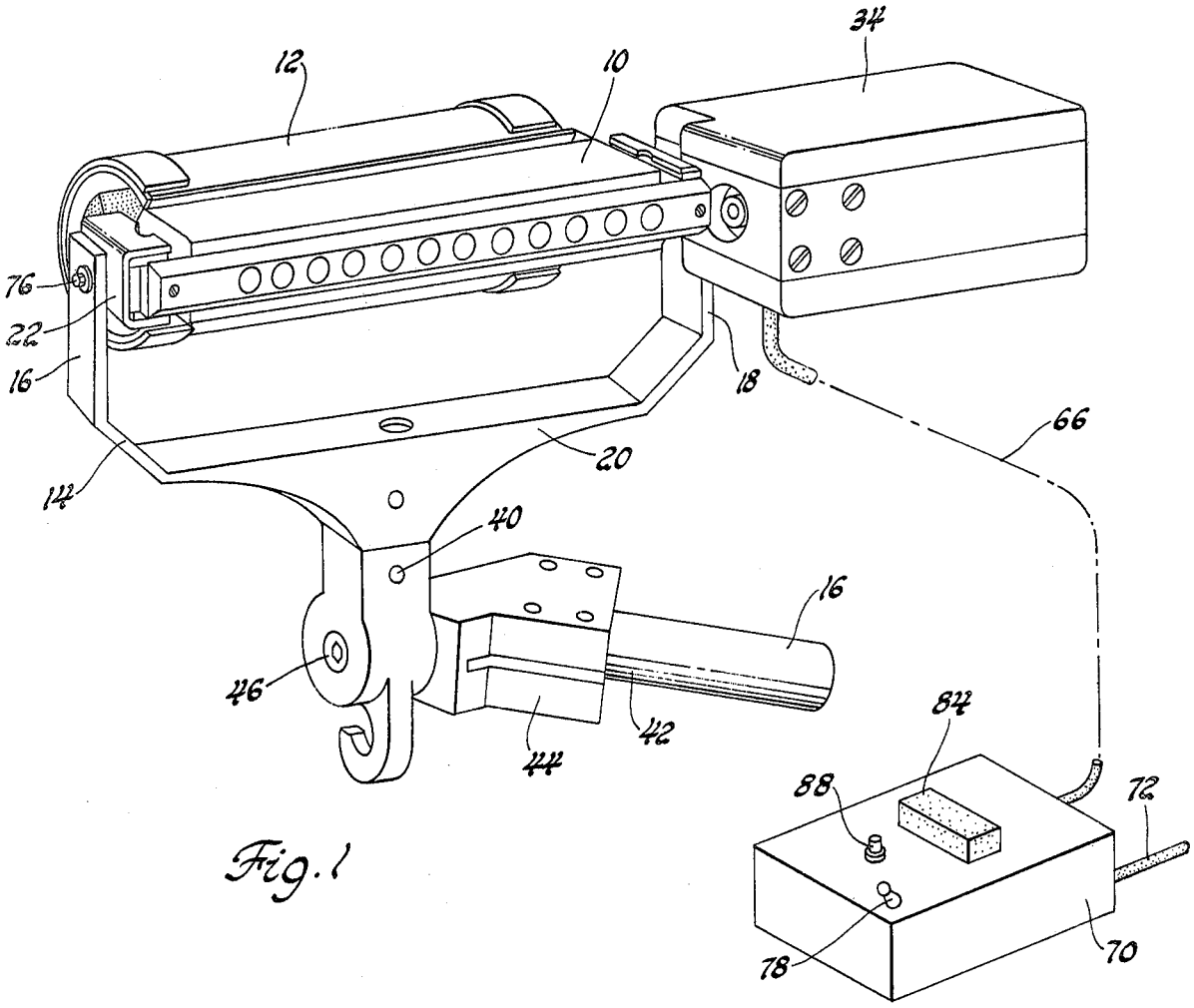
FIG. 1 is a perspective view illustrating a chromatic harmonica supported by a boom and connected to a foot-operated actuator in accordance with the preferred embodiment of the invention.

Referring to the drawing, FIG. 1 illustrates a conventional chromatic harmonica 10 having a conventional electrically-actuated amplifier 12. The harmonica is mounted in a yoke 14 which is suspended on the end of a conventional boom 16.

Yoke 14 is preferrably a one-piece member with a pair of spaced parallel arms 16 and 18 having their lower ends connected to a base 20. A pair of channel-shaped members 22 24 are mounted adjacent arms 16 and 18, respectively. A fastener 76 is mounted on arm 16 and connected to channel shaped member 22 to permit it to pivot with respect to the yoke. Similarly fastener 28 connects channel-shaped member 24 to arm 18 so that member 24 can be pivoted with respect to the yoke. A "U" shaped member 30 is mounted between and connected to the channel shaped members to pivot with them.

Figure 2:
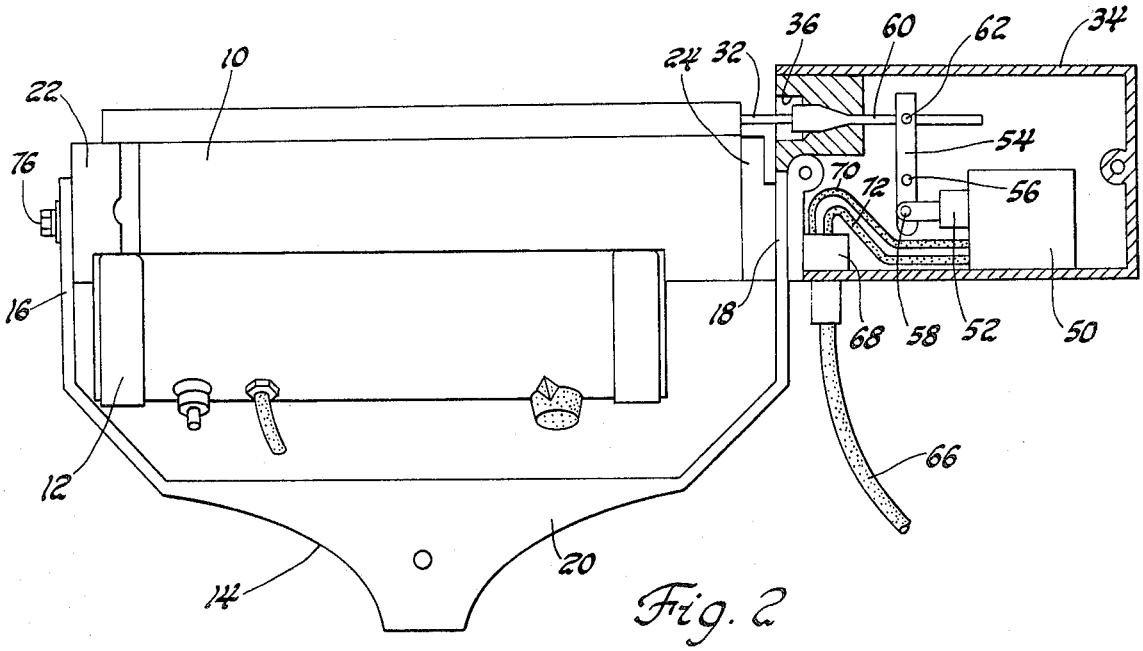
FIG. 2 is a view of a harmonica in its supporting yoke with the cover plate of the solenoid housing removed.
Figure 4:
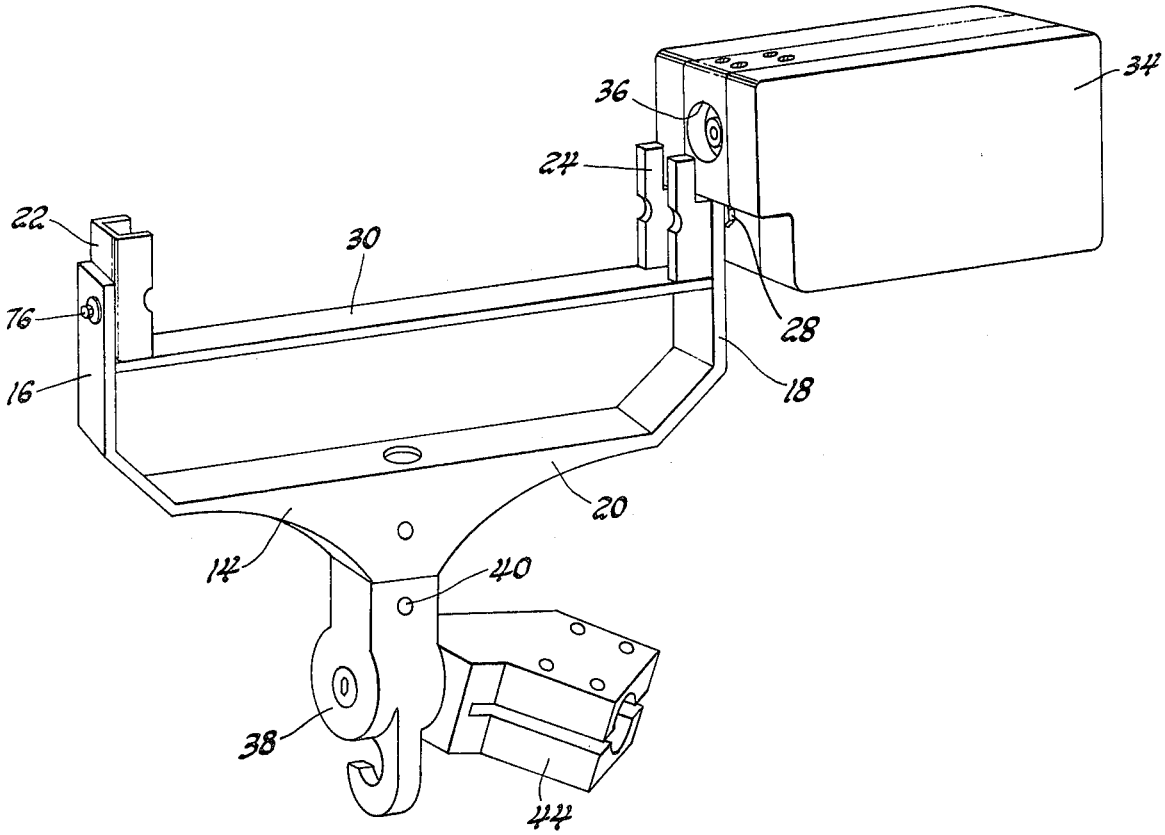
FIG. 4 is a view of the supporting yoke housing with the harmonica removed.

Harmonica 10 is elongated and as best illustrated in FIG. 2, has a valve member 32 adapted to change the tone produced by the harmonica between sharps and flats as desired. The harmonica has an internal spring which biases valve member 32 towards its extended position. Referring to FIG. 4, housing means 34 is connected by fastener means 28 to arm 18 so that the housing means pivots with the channel-shaped member and "U" shaped member 30. Housing means 34 has an opening 36. The harmonica is mounted between the channel-shaped members with its lower edge in abutment with the midsection of member 30 in such a position that the outer end of the valve member is received in opening 36.

Referring to FIG. 4, a hook member 38 is pivotally connected to base 20 by a pin not shown and locked in position by hex head screw 40. Conventional boom 42 is received in a split jaw 44 and connected by a hex screw 46 to member 38 so that the position of the yoke is adjusted with respect to the boom to accommodate the position of the harmonica with respect to the user.

Referring to FIG. 2, an electrically-actuated solenoid 50 is mounted in housing 34. Solenoid 50 has a magnetic plunger 52. A lever 54 is pivotally mounted on pin 56. One end of the lever is connected to plunger 52 by pin 58. A finger 60 is connected by pin 62 to the opposite end of lever 54 in such a manner that as the plunger is retracted by the solenoid, the lever pushes harmonica valve member 32 to the left as viewed in FIG. 2. When the plunger is extended, it permits the spring in the harmonica to return the valve member toward its extended position.

An electrical cable 66 is connected to a connector 68 mounted in the housing. A pair of electrical wires 70 and 72 connect the connector 66 to solenoid 50.

Figure 3:
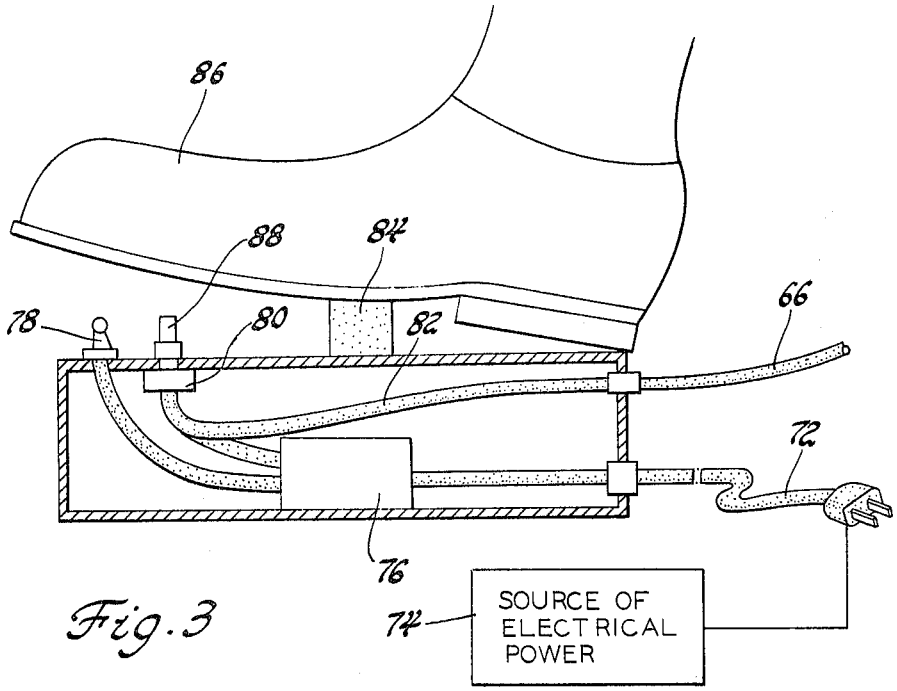
FIG. 3 is a fragmentary view of the foot-operated switch.

Referring to FIGS. 1 and 3, a foot support housing 70 is mounted on the floor (not shown) and has an electrical cord 72 adapted for connection to a source of electrical power 74. Cord 72 is connected internally in housing 70 to a transformer 76. An "on" and "off" switch 78 is mounted on the housing to provide an electrical connection between source of electrical energy 74 and a micro switch 80. Microswitch 80 is internally connected by electrical connector 82 to electrical connector 66.

A hard rubber pad 84 is mounted on the top of the housing approximately midway along its length. The housing has the length to accommodate foot 86 of the user so that his heel can rest adjacent one end of the housing but be pivoted about rubber pad 84.

Micro switch 80 has a plunger 88 mounted above the top surface of the housing beneath the user'sole, as illustrated. By pivoting his foot he can depress the micro switch plunger and thereby energize the solenoid to move the harmonica valve member. The arrangement is such that the valve member is very responsive to the motion of the micro switch because of the elimination of mechanical connections between the foot-operated support and the solenoid. Connector 66 is flexible so that the user can either stand, sit or move about without affecting the responsiveness of the harmonica to the foot control. The assembly can be easily adjusted on the boom to accommodate the position of the user and permits him to simultaneously play another instrument such as a guitar while playing the harmonica.

Although the harmonica has been illustrated as having a valve member extending beyond one of its ends, it is apparent that the invention can also be employed as a harmonica having a valve member button mounted in other positions such as the bottom of the harmonica case.

I claim:

1. In combination with an elongated chromatic harmonica having a movable valve member operative to change the harmonica so as to provide either sharp or flat tones depending upon the position of the valve member;

a yoke having a pair of arms for receiving the harmonica between them, and a base including a first arm and a second arm;

means for connecting the first arm to one end of the harmonica, and means for connecting the second arm to the opposite end of the harmonica such that the harmonica is supported between said arms;

a housing and means for mounting the housing on the yoke adjacent the valve member;

an electrically actuated solenoid mounted in said housing, the solenoid having a movable magnetic plunger, and lever means mounted on said housing between the valve member and the solenoid plunger such that the valve member is moved from a first position to a second position as the solenoid is electrically energized;

a foot support;

a source of electrical energy and an elongated flexible electrical connector mounted between the solenoid and said source of energy; and switch means mounted on the foot support and connected in the electrical connector means between the source of electrical energy and the solenoid such that the valve member is moved in response to a predetermined motion of the switch means.

2. A combination as defined in claim 1, including boom means attached to the base of the yoke.

3. A combination as defined in claim 1, in which said foot support comprises an elongated housing having a length accommodating the foot of the user, and a resilient pad mounted on the housing to permit the user's foot to pivot between a first position in which his heel is resting on the housing and a second position in which the user's heel is raised and his sole is lowered to engage the switch means.

4. Support means for a chromatic harmonica having a movable valve member comprising:

boom means;

a yoke having a first arm and a second arm, said arms each having one end joined together to form a base, and opposite ends spaced to receive the harmonica between them;

means for attaching the boom means to the yoke base at a selected angle thereto;

a first channel-shaped member having a pair of spaced sidewalls for receiving one end of the harmonica between the sidewalls, and a second channel-shaped member having a pair of sidewalls for receiving the opposite end of the harmonica between said sidewalls;

pivot means connecting each of said channel-shaped members to their respective ends of the harmonica to permit the harmonica to be pivoted to a selected position with respect to the yoke;

actuator means mounted on the yoke; and foot-operated means electrically connected to the actuator means for moving the valve member to either a first position or a second position depending upon the tone to be produced therefrom.

* * * * *